US011098399B2

(12) United States Patent
Paulino et al.

(10) Patent No.: US 11,098,399 B2
(45) Date of Patent: Aug. 24, 2021

(54) CERAMIC COATING SYSTEM AND METHOD

(71) Applicant: United Technologies Corporation, Hartford, CT (US)

(72) Inventors: Jose R. Paulino, Saco, ME (US); Christopher W. Strock, Kennebunk, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 1382 days.

(21) Appl. No.: 14/812,668

(22) Filed: Jul. 29, 2015

(65) Prior Publication Data

US 2016/0040548 A1 Feb. 11, 2016

Related U.S. Application Data

(60) Provisional application No. 62/033,883, filed on Aug. 6, 2014.

(51) Int. Cl.
*C23C 4/12* (2016.01)
*F01D 11/12* (2006.01)

(52) U.S. Cl.
CPC ..... *C23C 4/12* (2013.01); *F01D 11/122* (2013.01); *F05D 2230/90* (2013.01); *F05D 2240/11* (2013.01); *F05D 2300/20* (2013.01)

(58) Field of Classification Search
CPC ..... C23C 4/12; F01D 11/122; F01D 11/125; F01D 5/288; F01D 11/08; F01D 5/284; F05D 2230/90; F05D 2240/11; F05D 2300/20
See application file for complete search history.

(56) References Cited

U.S. PATENT DOCUMENTS 4,764,089 A * 8/1988 Strangman ..... F01D 11/122 415/173.4
5,681,616 A 10/1997 Gupta et al.
5,723,078 A 3/1998 Nagaraj et al.
6,316,078 B1 11/2001 Samialek
6,358,002 B1 3/2002 Good et al.
6,503,574 B1 1/2003 Skelly et al.
(Continued)

FOREIGN PATENT DOCUMENTS

DE 102005050873 4/2007
EP 0256790 2/1988
(Continued)

OTHER PUBLICATIONS

The Extended European Search Report for EP Application No. 15180090.1, dated May 24, 2016.

*Primary Examiner* — Kenneth Bomberg
*Assistant Examiner* — Jesse M Prager
(74) *Attorney, Agent, or Firm* — Carlson, Gaskey & Olds, P.C.

(57) ABSTRACT

A gas turbine engine article includes a substrate and a bond coating that covers at least a portion of the substrate with a step formed in at least one of the substrate and the bond coating. A thermally insulating topcoat is disposed on the bond coating. The thermally insulating topcoat includes a first topcoat portion separated by at least one fault that extends through the thermally insulating topcoat from a second topcoat portion.

22 Claims, 3 Drawing Sheets

(56) References Cited

U.S. PATENT DOCUMENTS

| | | | | |
|---|---|---|---|---|
| 6,652,227 | B2 | 11/2003 | Fried | |
| 6,821,578 | B2 | 11/2004 | Beele | |
| 7,334,985 | B2 | 2/2008 | Lutjen et al. | |
| 7,955,708 | B2 | 6/2011 | Doesburg et al. | |
| 8,506,243 | B2 | 8/2013 | Strock et al. | |
| 8,535,783 | B2 | 9/2013 | Lutjen et al. | |
| 2005/0266163 | A1 | 12/2005 | Wortman et al. | |
| 2011/0300342 | A1* | 12/2011 | Lutjen | B21K 23/00 428/173 |
| 2016/0369637 | A1* | 12/2016 | Subramanian | F01D 11/122 |

FOREIGN PATENT DOCUMENTS

| | | |
|---|---|---|
| EP | 0902104 | 3/1999 |
| EP | 2275645 | 1/2011 |
| EP | 2395129 | 12/2011 |

* cited by examiner

CERAMIC COATING SYSTEM AND METHOD

CROSS-REFERENCE TO RELATED APPLICATIONS

This application claims priority to U.S. Provisional Application No. 62/033,883 which was filed on Aug. 6, 2014 and is incorporated herein by reference.

STATEMENT REGARDING FEDERALLY SPONSORED RESEARCH OR DEVELOPMENT

This invention was made with government support under Contract No. FA 8650-09-D-2923-0021 awarded by the United States Air Force. The Government has certain rights in this invention.

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Components that are exposed to high temperatures during operation of the gas turbine engine typically require protective coatings. For example, components such as turbine blades, turbine vanes, blade outer air seals (BOAS), and compressor components may require at least one layer of coating for protection from the high temperatures.

Some BOAS for a turbine section include an abradable ceramic coating that contacts tips of the turbine blades such that the blades abrade the coating upon operation of the gas turbine engine. The abradable material allows for a minimum clearance between the BOAS and the turbine blades to reduce gas flow around the tips of the turbine blades to increase the efficiency of the gas turbine engine. Over time, internal stresses can develop in the protective coating to make the coating vulnerable to erosion and spalling. The BOAS may then need to be replaced or refurbished after a period of use. Therefore, there is a need to increase the longevity of protective coatings in gas turbine engines.

SUMMARY

In one exemplary embodiment, a gas turbine engine article includes a substrate and a bond coating that covers at least a portion of the substrate with a step formed in at least one of the substrate and the bond coating. A thermally insulating topcoat is disposed on the bond coating. The thermally insulating topcoat includes a first topcoat portion separated by at least one fault that extends through the thermally insulating topcoat from a second topcoat portion.

In a further embodiment of the above, the substrate includes a first substrate portion that has a first thickness and a second substrate portion that has a second thickness forming the step.

In a further embodiment of any of the above, the bond coating includes a first bond coat portion that has a first thickness and a second bond coat portion that has a second thickness forming the step.

In a further embodiment of any of the above, the faults are microstructural discontinuities between the first topcoat portion and the second top coat portion.

In a further embodiment of any of the above, the step includes a radially outer fillet having a second radius of less than 0.003 inches (0.076 mm)

In a further embodiment of any of the above, the step includes a radially inner edge that has a first radius of less than 0.003 inches (0.076 mm)

In a further embodiment of any of the above, a ratio of a sum of the first radius and the second radius is less than or equal to 25% of a radial height of the step.

In a further embodiment of any of the above, the step extends in a radial and circumferential direction between opposing circumferential sides of the turbine article.

In a further embodiment of any of the above, the fault forms a plane of weakness between the first topcoat portion and the second topcoat portion.

In a further embodiment of any of the above, the thermally insulating layer comprises a ceramic material and the substrate comprises a metal alloy.

In a further embodiment of any of the above, geometric surface features are formed in the bond coat forming faults in the thermally insulating topcoat.

In a further embodiment of any of the above, the turbine article is a blade outer air seal and the first bond coat portion is located on a leading edge of the blade outer air seal. The second bond coat portion is located downstream of the first bond coat portion. The first thickness is greater than the second thickness.

In another exemplary embodiment, a turbine section for a gas turbine engine includes at least one turbine blade. At least one blade outer air seal includes a first portion that has a first thickness and a second portion that has a second thickness forming a step. A thermally insulating topcoat is disposed over the first portion and the second portion. The thermally insulating topcoat includes faults that extend from the step through the thermally insulating topcoat separating the thermally insulating topcoat between a first topcoat portion that has a first topcoat thickness and a second topcoat portion having a second topcoat thickness.

In a further embodiment of the above, the first topcoat portion is located adjacent a leading edge of at least one blade outer air seal. The second topcoat portion is located axially downstream of the first topcoat portion. The first topcoat thickness is less than the second topcoat thickness.

In a further embodiment of any of the above, the first portion is located axially upstream of at least one turbine blade. The step extends in a radial and circumferential direction between opposing circumferential sides of the blade outer air seal.

In a further embodiment of any of the above, a third portion has a third thickness located downstream of the second portion and at least one turbine blade. The first thickness and the third thickness is greater than the second thickness. The first portion, the second portion and the third portion are a bond coating.

In a further embodiment of any of the above, the faults are microstructural discontinuities between the first topcoat portion and the second topcoat portion. The first portion and the second portion are located in at least one of a bond coat or a substrate.

In a further embodiment of any of the above, the step includes a curved upper edge that has a first radius and a fillet that has a second radius. At least one of the first radius and the second radius is less than 0.003 inches (0.076 mm). A ratio of a sum of the first radius and the second radius is less than or equal to 25% of a radial height of the step.

In another exemplary embodiment, a method of forming a gas turbine engine article includes forming a step on the article between a first portion having a first thickness and a second portion have a second thickness. Depositing a thermally insulating topcoat over the first portion and the second portion such that the thermally insulating topcoat forms with faults that extend from the step through the thermally insulating topcoat to separate a first topcoat portion from a second topcoat portion.

In a further embodiment of the above, the step includes a curved upper edge having a first radius and a fillet having a second radius. At least one of the first radius and the second radius is less than 0.003 inches (0.076 mm) A ratio of a sum of the first radius and the second radius is less than or equal to 25% of a radial height of the step.

In a further embodiment of any of the above, the method includes depositing the thermally insulating topcoat with a thermal spray process such that portions of the thermally insulating topcoat build up discontinuously between the first portion and the second portion.

In a further embodiment of any of the above, the step extends in a radial and circumferential direction between opposing circumferential sides of the gas turbine article. The first portion and the second portion are located in at least one of a bond coat or a substrate.

The various features and advantages of this disclosure will become apparent to those skilled in the art from the following detailed description. The drawings that accompany the detailed description can be briefly described as follows.

DETAILED DESCRIPTION

Figure 1:
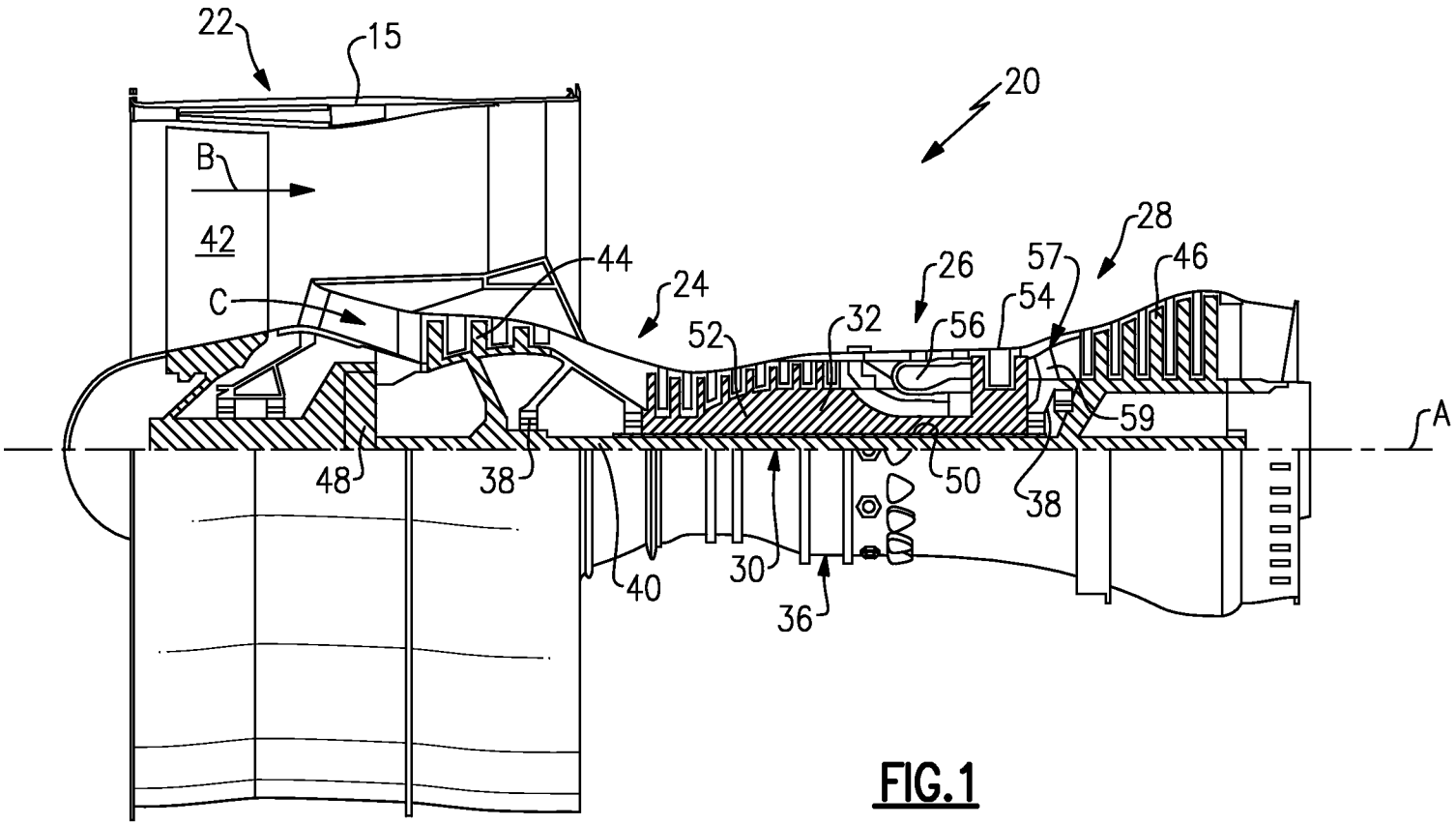
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
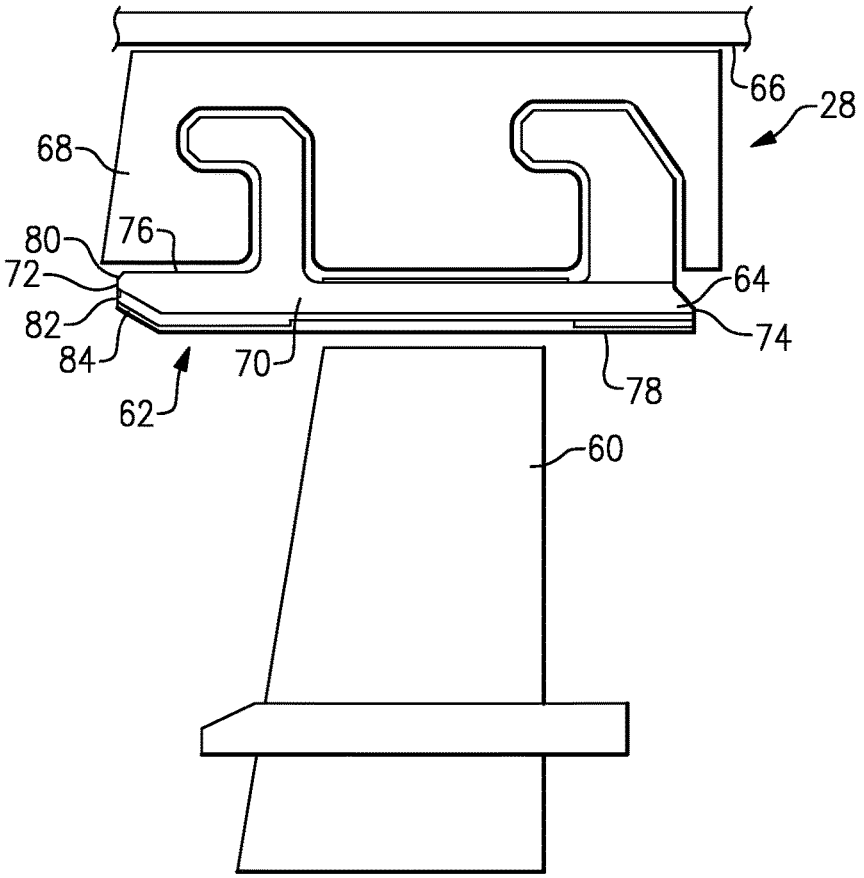
FIG. 2 illustrates a turbine section of the gas turbine engine of FIG. 1.

FIG. 2 illustrates a portion of the turbine section 28 of the gas turbine engine 20. Turbine blades 60 receive a hot gas flow from the combustor section 26 (FIG. 1). A blade outer air seal (BOAS) system 62 is located radially outward from the turbine blades 60. The BOAS system 62 includes multiple seal members 64 circumferentially spaced around the axis A of the gas turbine engine 20. Each seal member 64 is attached to a case 66 surrounding the turbine section by a support 68. It is to be understood that the seal member 64 is only one example of an article within the gas turbine engine that may benefit from the examples disclosed herein.

Figure 3:
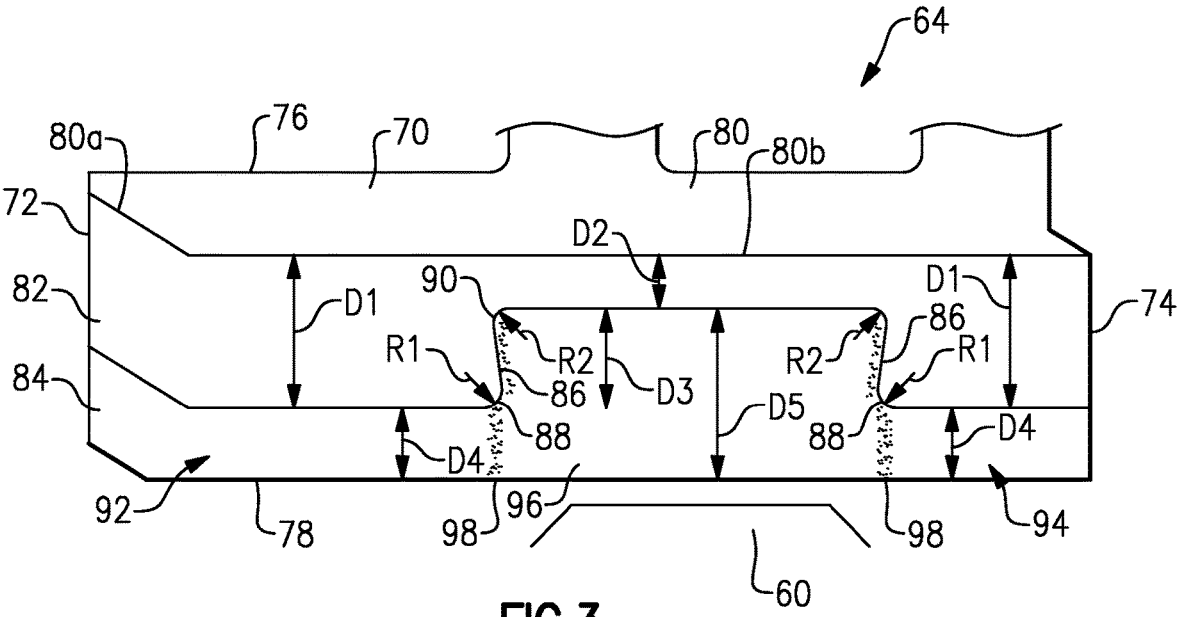
FIG. 3 illustrates an example portion of a turbine component.

FIG. 3 illustrates a portion of the seal member 64 having two circumferential sides 70 (one shown), a leading edge 72, a trailing edge 74, a radially outer side 76, and a radially inner side 78 that is adjacent the hot gas flow and the turbine blade 60. The term "radially" as used in this disclosure relates to the orientation of a particular side with reference to the axis A of the gas turbine engine 20.

The seal member 64 includes a substrate 80, a bond coat 82 covering a radially inner side of the substrate 80, and a thermally insulating topcoat 84 covering a radially inner side of the bond coat 82. In this example, the bond coat 82 covers the entire radially inner side of the substrate 80 and the thermally insulating topcoat 84 is a thermal barrier made of a ceramic material. The substrate 80 includes a slanted region 80*a* adjacent the leading edge 72 and a downstream portion 80*b* having a generally constant radial dimension.

The bond coat 82 includes a thicker region D1 adjacent the leading edge 72 and the trailing edge 74 and a thinner region D2 axially between the thicker regions D1. The thinner region D2 extends axially from upstream of the turbine blade 60 to downstream of the turbine blade 60.

A step 86 is formed in the bond coat 82 between both of the thicker regions D1 and the thinner region D2. The step 86 extends in a radial and circumferential direction such that multiple BOAS systems 62 arranged together form a circumference around the axis A of the gas turbine engine 20 with the step 86 extending entirely around the circumference.

The step 86 incudes a radially inner edge 88 having a radius R1 and a radially outer fillet 90 having a radius R2. In one example, the step 86 extends generally perpendicular to the axis A of the gas turbine engine 20. In another example, the step 86 extends in a non-perpendicular direction such that the step forms an undercut. The step 86 extends for a radial thickness D3.

In one example, the sum of R1 and R2 equals less than or equal to 50% of the thickness of region D3. In another example, the sum of R1 and R2 equals less than or equal to 25% of the thickness of region D3.

The thermally insulating topcoat 84 includes a leading edge region 92 and a trailing edge region 94 having a thickness D4 and an axially central region 96 having a thickness D5. The central region 96 extends from axially upstream of the turbine blade 60 to axially downstream of the turbine blade 60. The leading edge region 92 and the trailing edge region 94 are separated from the central region 96 by faults 98 extending radially through the thickness of the thermally insulating topcoat 84.

The faults 98 extend from the steps 86 formed in the bond coat 82 and reduce internal stresses within the thermally insulating topcoat 84 that may occur from sintering of the thermal material at relatively high surface temperatures within the turbine section 28 during use of the gas turbine engine 20. Although the central region 96 is separated from the trialing edge 74 by the trailing edge region 94, the central region 96 could extend to the trailing edge 74.

In one example, the thickness of region D1 is approximately 0.019 inches (0.483 mm), the thickness of region D4 is approximately 0.012 inches (0.305 mm), the thickness of region D2 is approximately 0.007 inches (0.178 mm), the thickness of region D3 is approximately 0.012 inches (0.305 mm) and the thickness of region D5 is approximately 0.025 inches (0.635 mm). In one example, at least one of the radius R1 and the radius R2 are approximately 0.003 inches (0.076 mm). In another example, at least one of the radius R1 and the radius R2 are less than 0.004 inches (0.102 mm). In yet another example, at least one of the radius R1 and the radius R2 are less than 0.005 inches (0.127 mm).

Depending on the composition of the thermally insulating topcoat 84, surfaces temperatures of about 2500° F. (1370° C.) and higher may cause sintering. The sintering may result in partial melting, densification, and diffusional shrinkage of the thermally insulating topcoat 84. The faults 98 provide pre-existing locations for releasing energy associated with the internal stresses (e.g., reducing shear and radial stresses). That is, the energy associated with the internal stresses may be dissipated in the faults 98 such that there is less energy available for causing delamination cracking between the thermally insulating topcoat 84 and the bond coat 82.

The faults 98 may vary depending upon the process used to deposit the thermally insulating topcoat 84. In one example, the faults 98 may be gaps between adjacent regions. In another example, the faults 98 may be considered to be microstructural discontinuities between the adjacent regions 92, 94, and 96. The faults 98 may also be planes of weakness in the thermally insulating topcoat 84 such that the regions 92, 94, and 96 can thermally expand and contract without cracking the thermally insulating topcoat 84.

The material selected for the substrate 80, the bond coat 82, and the thermally insulating topcoat 84 are not necessarily limited to any kind. In one example, the substrate 80 is made of a nickel based alloy and the thermally insulating topcoat 84 is an abradable ceramic material suited for providing a desired heat resistance.

The faults 98 in the thermally insulating topcoat 84 on the seal member 64 may be formed during application of the thermally insulating topcoat 84. Once the bond coat 82 has been applied to the substrate 80, the bond coat 82 is machined or ground to form the step 86 with the radially outer fillet 90 and the radially inner edge 88 having the desired radius R2 and R1, respectively. Alternatively, the step 86 is formed in the substrate 80 and the bond coat 82 is only applied to the radially inward facing portions of the substrate 80 excluding the step 86 in order to facilitate formation of the fault 98 along the step 86. Therefore, the substrate 80 would include a first portion have a first thickness and a section portion having a second thickness different from the first thickness The thermally insulating topcoat 84 is applied to the bond coat 82 and/or substrate 80 with a thermal spray process. The thermal spray process allows the thermally insulating topcoat 84 to build up discontinuously such that there is no bridging between the leading edge region 92, the central region 96, and the trailing edge region 94. Because of the discontinuity created by the step 86, the continued buildup of the thermally insulating topcoat 84 between the central region 96 and the leading and trailing regions 92 and 94 forms the faults 98. The radially inner side 78 of the seal member 64 may be machined to remove unevenness introduced by the varying thickness associated with thermal spraying the step 86.

Figure 4:
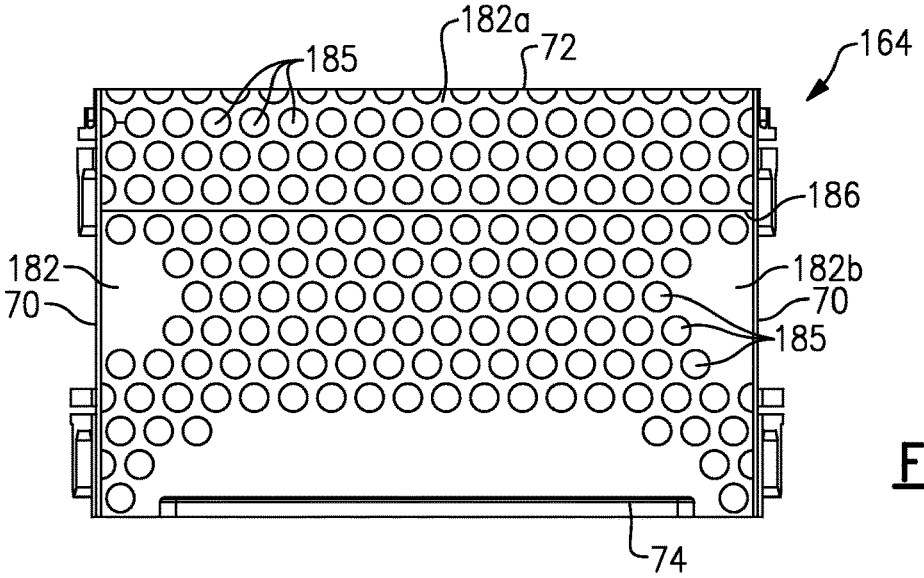
FIG. 4 illustrates a perspective view of another example turbine component.
Figure 5:
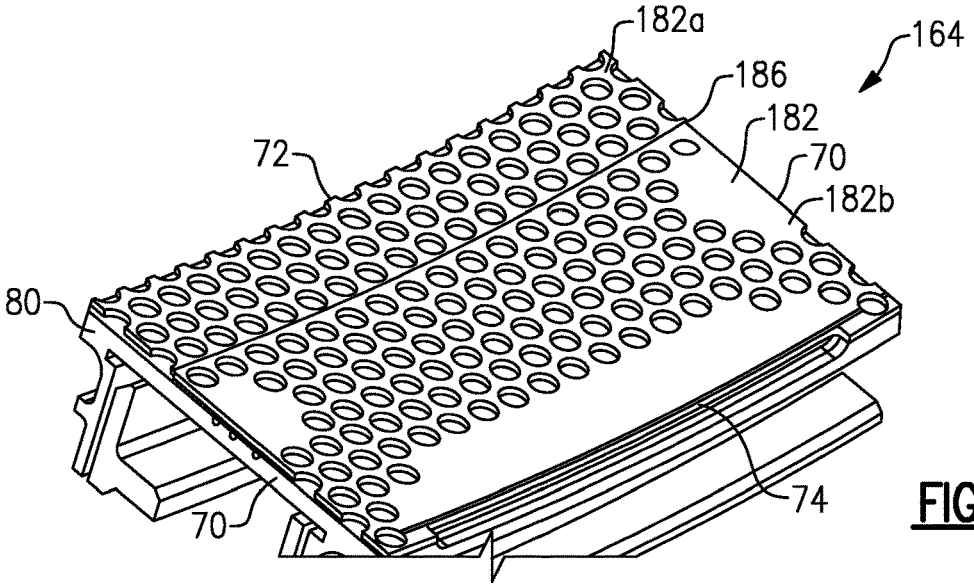
FIG. 5 illustrates another perspective view of the turbine component of FIG. 4.
Figure 6:
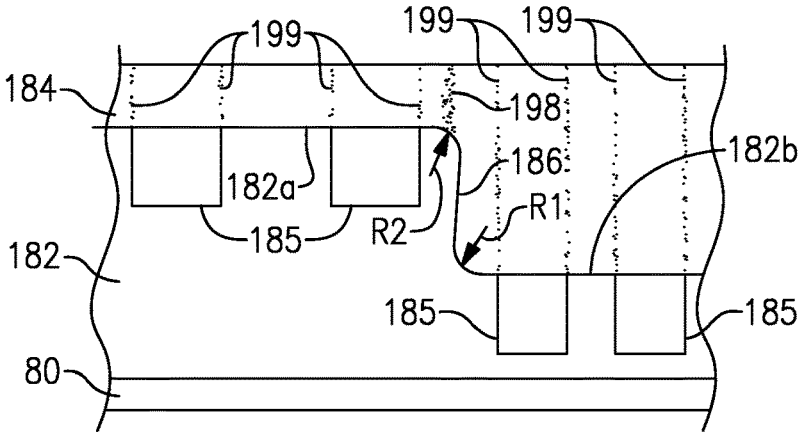
FIG. 6 illustrates an example portion of the turbine component of FIG. 4.

FIGS. 4-6 illustrate another example seal member 164. The seal member 164 is similar to the seal member 64 except where described below or shown in the Figures. The seal member 164 includes the substrate 80 covered by a bond coat 182. The bond coat includes a leading edge portion 182*a* axially upstream of a step 186 and a trailing edge portion 182*b* axially downstream of the step 186. The leading edge portion 182*a* and the trailing edge portion 182*b* include geometric features 185 formed in the bond coat 182. In this example, the geometric features 185 are cylindrical. However, other shapes such as elliptical or rectangular rods could be formed in the bond coat 182. Alternatively, the geometric features 185 could be formed in the substrate 80 with the radially inner surface of the substrate 80 being covered with the bond coat 182.

The thermally insulating topcoat 84 can be applied as discussed above. However, when the thermally insulating topcoat 84 is applied over the geometric features 185, faults 199 will form in the thermally insulating topcoat 184 in addition to a fault 198 formed radially inward from the step 186. The faults 198 and 199 form in a similar fashion as the faults 98 described above.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A gas turbine engine article comprising:

a substrate;

a bond coating covering at least a portion of the substrate with a step extending to opposing circumferential sides of the article and formed in the bond coating; and a thermally insulating topcoat disposed on the bond coating, the thermally insulating topcoat includes a first topcoat portion separated by at least one fault extending through the thermally insulating topcoat from a second topcoat portion.

2. The article of claim 1, wherein the bond coating includes a first bond coat portion having a first thickness and a second bond coat portion having a second thickness forming the step.

3. The turbine article of claim 1, wherein the faults are microstructural discontinuities between the first topcoat portion and the second top coat portion.

4. The turbine article of claim 3, wherein the step includes a radially outer fillet having a second radius of less than 0.003 inches (0.076 mm).

5. The turbine article of claim 4, wherein the step includes a radially inner edge having a first radius of less than 0.003 inches (0.076 mm).

6. The turbine article of claim 5, wherein a ratio of a sum of the first radius and the second radius is less than or equal to 25% of a radial height of the step.

7. The turbine article of claim 1, wherein the step extends in a radial and circumferential direction between opposing circumferential sides of the turbine article.

8. The turbine article of claim 1, wherein the fault forms a plane of weakness between the first topcoat portion and the second topcoat portion.

9. The turbine article of claim 1, wherein the thermally insulating layer comprises a ceramic material and the substrate comprises a metal alloy.

10. The turbine article of claim 1, further comprising geometric surface features formed in the bond coat forming faults in the thermally insulating topcoat.

11. The turbine article of claim 2, wherein the turbine article is a blade outer air seal and the first bond coat portion is located on a leading edge of the blade outer air seal and the second bond coat portion is located downstream of the first bond coat portion and the first thickness is greater than the second thickness.

12. A turbine section for a gas turbine engine comprising at least one turbine blade;

at least one blade outer air seal including a bond coating with a first portion having a first thickness and a second portion having a second thickness forming a step extending to opposing circumferential sides of the at least one blade outer air seal; and a thermally insulating topcoat disposed over the first portion and the second portion, the thermally insulating topcoat including faults extending from the step through the thermally insulating topcoat separating the thermally insulating topcoat between a first topcoat portion having a first topcoat thickness and a second topcoat portion having a second topcoat thickness.

13. The turbine section of claim 12 wherein the first topcoat portion is located adjacent a leading edge of the at least one blade outer air seal, the second topcoat portion is located axially downstream of the first topcoat portion, and the first topcoat thickness is less than the second topcoat thickness.

14. The turbine section of claim 13, wherein the first portion is located axially upstream of the at least one turbine blade and the step extends in a radial and circumferential direction between opposing circumferential sides of the blade outer air seal.

15. The turbine section of claim 14, further comprising a third portion having a third thickness located downstream of the second portion and the at least one turbine blade, wherein the first thickness and the third thickness is greater than the second thickness and the first portion, the second portion and the third portion are a bond coating.

16. The turbine section of claim 12, wherein the faults are microstructural discontinuities between the first topcoat portion and the second topcoat portion.

17. The turbine section of claim 12, wherein the step includes a curved upper edge having a first radius and a fillet having a second radius, at least one of the first radius and the second radius is less than 0.003 inches (0.076 mm), and a ratio of a sum of the first radius and the second radius is less than or equal to 25% of a radial height of the step.

18. A method of forming a gas turbine engine article, comprising:

forming a step on the article in a bond coating with a first portion having a first thickness and a second portion have a second thickness, wherein the step extends to opposing circumferential sides of the article; and depositing a thermally insulating topcoat over the first portion and the second portion such that the thermally insulating topcoat forms with faults that extend from the step through the thermally insulating topcoat to separate a first topcoat portion from a second topcoat portion.

19. The method of claim 18, wherein the step includes a curved upper edge having a first radius and a fillet having a second radius, at least one of the first radius and the second radius is less than 0.003 inches (0.076 mm), and a ratio of a sum of the first radius and the second radius is less than or equal to 25% of a radial height of the step.

20. The method as recited in claim 19, further comprising depositing the thermally insulating topcoat with a thermal spray process such that portions of the thermally insulating topcoat builds up discontinuously between the first portion and the second portion.

21. The method as recited in claim 20, wherein the step extends in a radial direction.

22. The turbine section of claim 12, wherein the step extends in a non-perpendicular direction relative to an axis of the gas turbine engine such that the step forms an undercut.

* * * * *